United States Patent [19]

Ragg et al.

[11] Patent Number: 4,867,128

[45] Date of Patent: Sep. 19, 1989

[54] FUEL INJECTION NOZZLE

[75] Inventors: Peter W. Ragg, Mount Lawley; Roy S. Brooks, South Perth, both of Australia

[73] Assignee: Orbital Engine Company Proprietary, Balcatta, Australia

[21] Appl. No.: 40,778

[22] PCT Filed: Jul. 18, 1986

[86] PCT No.: PCT/AU86/00201

§ 371 Date: Mar. 11, 1987

§ 102(e) Date: Mar. 11, 1987

[87] PCT Pub. No.: WO87/00584

PCT Pub. Date: Jan. 29, 1987

[30] Foreign Application Priority Data

Jul. 19, 1985 [AU] Australia ..... PH01557

[51] Int. Cl.[4] ..... F02M 61/04; F02M 61/08; F02M 61/18; F02M 67/12

[52] U.S. Cl. ..... 123/531; 123/305; 239/5; 239/460; 239/533.12

[58] Field of Search ..... 123/531–535, 123/299, 300, 305; 239/5, 406, 453, 459, 460, 464, 472, 487, 533.2–533.12, 585, 601

[56] References Cited

U.S. PATENT DOCUMENTS

| | | | |
|---|---|---|---|
| 1,617,736 | 2/1927 | Arnold . | |
| 2,183,284 | 12/1939 | Wiebicke . | |
| 2,213,928 | 9/1940 | Gold et al. . | |
| 2,263,197 | 11/1941 | Tabb et al. . | |
| 3,838,821 | 10/1974 | Berlyn . | |
| 3,892,208 | 7/1975 | Anderson et al. | 123/299 |
| 4,082,224 | 4/1978 | Magnus . | |
| 4,149,497 | 4/1979 | Zeliszkewycz | 123/533 |
| 4,549,696 | 10/1985 | Gaskell | 239/452 |

FOREIGN PATENT DOCUMENTS

| | | |
|---|---|---|
| 483935 | 10/1929 | Fed. Rep. of Germany . |
| 723801 | 8/1942 | Fed. Rep. of Germany . |
| 916365 | 8/1954 | Fed. Rep. of Germany . |
| 86/00668 | 1/1986 | PCT Int'l Appl. . |
| 542371 | 1/1942 | United Kingdom . |
| 1219826 | 1/1971 | United Kingdom . |
| 2057057 | 3/1981 | United Kingdom . |
| 2088950 | 6/1982 | United Kingdom . |
| 2097471 | 11/1982 | United Kingdom . |
| 2133833 | 8/1984 | United Kingdom . |

*Primary Examiner*—Tony M. Argenbright
*Attorney, Agent, or Firm*—Armstrong, Nikaido, Marmelstein, Kubovcik & Murray

[57] ABSTRACT

A nozzle for the injection of liquid fuel by compressed gas which produces a generally circular first array of gas-entrained fuel droplets and a second array of gas-entrained fuel droplets within the first array. The preferred nozzle has an outwardly opening poppet valve with notches (65) on the perimetal edge of the valve head (48). The division of the fuel-gas charge into two arrays reduces penetration of the charge into the combustion chamber with beneficial effect on combustion efficiency and exhaust emissions. Also disclosed is an arrangement in which an un-notched poppet valve cooperates with a notched valve port to similarly obtain division of the fuel-gas charge into two arrays.

39 Claims, 6 Drawing Sheets

FUEL INJECTION NOZZLE

This invention relates to a method of injecting a fuel-air mixture into the combustion chamber of an internal combustion engine in a manner to control the fuel distribution with the chamber.

The characteristics of the spray of the fuel droplets issuing from a nozzle into a combustion chamber have major effects on the efficiency of the burning of the fuel which in turn affects the stability of the operation of the engine, the fuel efficiency and the exhaust emissions. To optimise these effects in a spark ignited engine the desirable characteristics of the spray pattern of the fuel issuing from the nozzle include small fuel droplet size, controlled penetration of the fuel spray into the chamber, and at least at low engine loads a relatively contained evenly distributed cloud of fuel droplets.

Some known injection nozzles, used for the delivery of fuel directly into the combustion chamber of an engine, are of the poppet valve type from which the fuel issues in the form of a hollow divergent conical spray, with the fuel droplets forming a continuous wall of the cone extending from the peripheral edge of the poppet valve. The continuous nature of the wall of fuel droplets restricts the extent of atomisation of the fuel, and the dispersion of the fuel droplets in the air to form a fuel mist cloud, which is desirable for ignition and complete combustion of the fuel. Also the continuous wall of fuel droplets, issuing as a continuation of the direction of flow of the droplets from the nozzle, increases the extent of penetration of the fuel into the cylinder which is particularly undesirable under light fuelling conditions.

It is therefore the object of the present invention to provide a method of injecting fuel through a nozzle into a combustion chamber, and a nozzle construction, which will contribute to a reduction in the problems experienced with existing nozzles and to improve emissions control and engine operation stability.

With this object in view there is provided according to one aspect of the present invention a method of injecting fuel into a combustion chamber of an engine comprising entraining the fuel in a gas and selectively injecting the resultant fuel-gas mixture into the combustion chamber, and providing during injection to the combustion chamber alternate first and second flow paths for at least part of the fuel-gas mixture so that part of the fuel-gas mixture forms an array of alternate first and second fuel-gas mixture streams issuing into the combustion chamber.

Preferably the first array of gas entrained fuel droplets issues to form a divergent cone formation and the second array of droplets preferably issues to form a formation which is not divergent, and conveniently issues into a somewhat cylindrical formation or inwardly converging conical formation, disposed within the confines of the outwardly divergent formation of the first array.

More specifically there is provided a method of injecting fuel into a combustion chamber of an engine comprising entraining the fuel in a gas stream and selectively opening a port to inject the fuel-gas mixture so formed into the combustion chamber, and promoting preferred respective paths for the fuel-gas mixture as it passes through the port to produce a first array of generally circular cross-section of gas entrained fuel droplets and a second array of gas entrained fuel droplets within the area defined by the first array issuing from the port.

In accordance with another aspect of the present invention there is provided a method of injecting fuel into a combustion chamber of an engine comprising entraining the fuel in a gas and selectively opening a port to discharge the fuel-gas mixture so formed into the combustion chamber, and promoting preferred respective paths of gas and fuel as the mixture passes through the open port to produce an array of fuel-gas mixture with alternate regions of differing fuel content around the port.

Preferably the fuel-gas mixture issues with the array of a circular or arcuate cross-section about the axis of the port. The array may be such that alternate regions diverge outwardly about the axis of the port to form a generally conical array and the other regions are in a circular formation about the axis of the port, and are preferably of a converging conical formation.

The dividing of the fuel-gas charge into two arrays more widely distributes the charge and so reduces the velocity thereof with resultant reduction in the momentum of the fuel droplets and penetration thereof into the combustion chamber. In this regard it is desirable for the charge to attain sonic or above sonic velocity at the point of issue from the port in order to promote atomisation. However, high velocities after entry to the combustion chamber are not desirable as they result in deep penetration of the fuel into the combustion chamber. The dividing of the fuel-gas charge as currently proposed assists in permitting sonic velocity of the charge at entry without a corresponding high penetration fuel spray.

The change in direction of part of the fuel-gas charge to establish the two arrays also reduces the velocity of that part of the fuel-gas charge with respect to the part that does not change direction, thus further reducing fuel penetration. Also it is believed that the change in direction is more readily accommodated by the gas than the fuel droplets, due to the relative densities and resulting momentum effects, and so the inner array is of somewhat lower density.

It is believed that the effect of the hollow spray is that, due to entrainment-induced effects in the gas within the conical array, vortices are produced adjacent the array within the hollow spray of fuel-gas charge issuing from the port. This vortex production effect is particularly effective when the liquid fuel is entrained in a gas as compared with a liquid fuel alone injection system. In the liquid alone injection system there is minimum expansion as the fuel issues through a port and so any vortex production effects only extend to the gas in the combustion chamber within the area immediate to the spray.

In contrast in the present proposal, where the liquid fuel is entrained in gas, the substantial pressure drop through the port will result in a substantial expansion of the gas issuing into the combustion chamber with the fuel. The vortex production effect is thus more widely spread and the liquid fuel droplets carried in the gas are similarly spread. The above reference to the wide spread of the vortex production effect refers to a spread within the ambit of the fuel spray issuing from the port and not to substantial spread throughout the whole combustion chamber.

The overall effect of entraining the fuel in a gas and injecting the fuel-gas charge so created into the combustion chamber in the form of two concentric arrays of fuel droplet streams, is to limit the extent of penetration of the fuel into the chamber, and to provide a confined fuel cloud, with fuel distributed therethroughout, at the injection point.

When the arrays are such that the streams of fuel droplets are in a circular or conical formation, a toroidal air flow is created within the formation generally concentric therewith. The air flow in the outer region of the toroid compliments that of the fuel droplets issuing from the port, and fuel becomes entrained in the toroidal air flow to be carried inward of the formation. This dispersion of the fuel droplets contributes to the distribution of the fuel while retaining it within a defined area.

In accordance with another aspect of the present invention there is provided a method of injecting fuel into a combustion chamber of an engine comprising entraining the fuel in a gas and selectively opening a port to inject the resultant fuel-gas mixture into the combustion chamber, and promoting preferred respective paths of gas and fuel as the mixture passes through the open port to produce an array of alternate areas of fuel rich and fuel lean mixtures around the port.

More specifically there is provided in a fuel injection system for an internal combustion engine where fuel entrained in gas is injected into an engine combustion chamber, a selectively openable nozzle means through which the fuel-gas mixture is delivered to the combustion chamber and incorporating a flow divider means, in the path of the mixture issuing from the nozzle means when open, to form a first array of generally circular cross-section of gas entrained fuel droplets and a second array of gas entrained fuel droplets within the area defined by the first array.

Another aspect of the present invention provides, in a fuel injection system where fuel entrained in gas is injected into a combustion chamber, a selectively openable nozzle means through which the fuel-gas mixture is injected into the combustion chamber, said nozzle means being adapted to produce an array of alternate zones of differing fuel content fuel-gas mixtures issuing therefrom when the nozzle means is open.

Conveniently the nozzle means includes means located in the path of the fuel-gas mixture, when the nozzle is open, and adapted to divide the flow of the fuel-gas mixture into zones of differing fuel content. Preferably the nozzle means is in the form of a poppet valve having a movable valve element co-operating with a port to provide a seal area therebetween when the nozzle is closed, with the divider means downstream of the seal area. The divider means may be integral with the port or the valve element or respective co-operating portions of the flow director may be integral with each.

Preferably the movable valve element of the poppet valve is provided with a plurality of notches spaced around the periphery of the terminal edge portion. The provision of these notches provides two alternative sets of paths for the fuel-gas mixture, an outer set formed by the un-notched portions of the terminal edge of the valve element, and the other set passing through the notches to be thereby displaced radially inward from the terminal edge of the valve element.

The surface of the valve element over which the fuel-gas mixture passes when the nozzle is open is preferably of a divergent conical form so that the fuel-gas mixture issuing from the terminal edge will initially maintain this direction of flow to form an outer array of gas entrained fuel droplets. However where the terminal edge is interrupted by the notches the fuel and gas presented to the notch will flow therethrough to issue from the nozzle inwardly of the terminal edge.

The wall attachment effect present when a fluid is flowing along a surface is believed to also contribute to the nature of the flow of the gas and fuel mixture through the notches.

It is believed that the gas is more susceptible to the wall attachment effect than the fuel and, together with the effects of the surface tension of the fuel, result in some shedding of fuel from the fuel-gas mixture at the edge of the notch which is first encountered by the mixture passing over the valve element. The shedded fuel is directed to flow around, rather than through, the notch and so becomes entrained in and enriches the fuel-gas mixture flowing down the un-notched areas of the valve element. The momentum effects on the fuel may also contribute to some shedding of fuel from the gas diverted through the notches.

This breaking up of the fuel-gas mixture into a plurality of arrays of fuel droplet streams provides a greater access for the fuel droplets to mix with the gas, and the additional edge length derived by the provision of notches increases the effect of shearing on the fuel droplets to achieve greater atomisation of the fuel.

The streams of fuel-gas mixture issuing from the terminal edge of the valve element in a conical formation establishes a toroidal like vortex flow within the confines of the conical formation. The direction of this toroidal vortex flow is such that the radial outer part thereof, adjacent the fuel-gas streams in the conical formation, is moving in the same direction as those streams. This flow picks up fuel droplets from the streams and carries them inwardly of the conical formation. The result is that the fuel-gas streams are further broken up to increase distribution of the fuel, and to form a contained fuel mist cloud extending across the full extent of the conical formation initiated by the fuel-gas stream issuing from the valve element. The breaking up and drawing inwardly of the fuel-gas mixture also limits the depth of penetration of the fuel into the combustion chamber and so may retain a rich mixture in the area of a spark plug in the region of the fuel injector for ready ignition, and limits dispersion of fuel into remote areas of the combustion chamber.

The fuel-gas cloud contains a constrained mass of fuel droplets finely dispersed and mixed with sufficient air to provide a readily ignitable fuel charge.

The invention will be more readily understood from the following description of a practical arrangement of apparatus for delivering fuel to an engine and several constructions of the valve control nozzles through which a fuel-air mixture is delivered to the combustion chamber of an engine.

Figure 1:
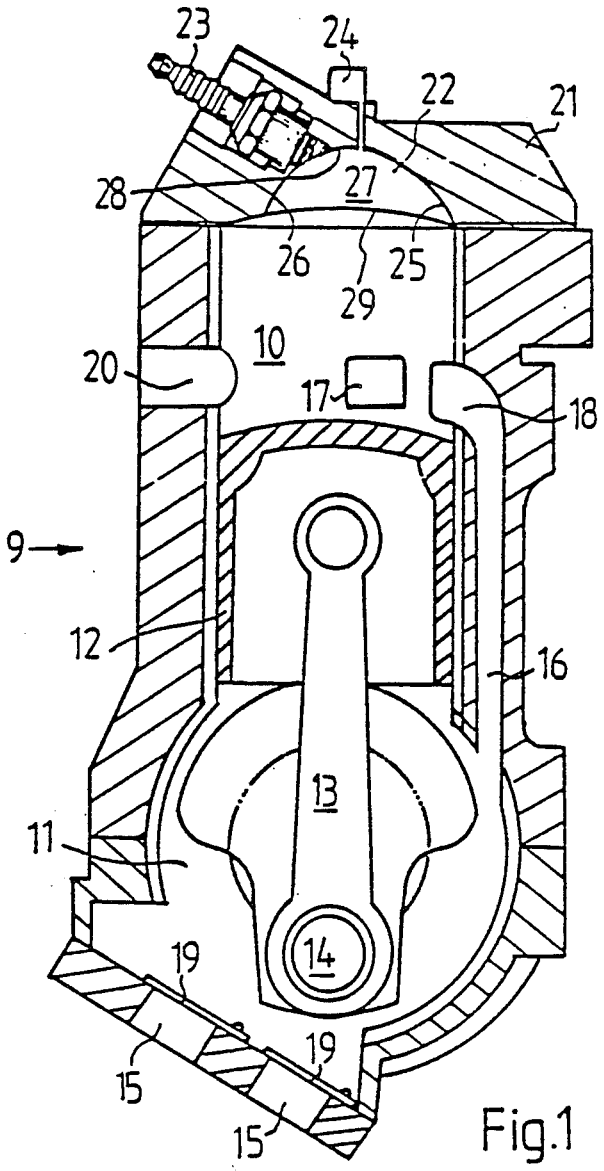
FIG. 1 is a longitudinal sectional view of a two stroke cycle engine to which the presently proposed fuel injection method and apparatus is applied.

Referring now to FIG. 1 the engine 9 is a single cylinder two-stroke cycle engine, of generally conventional construction, having a cylinder 10, crankcase 11 and piston 12 that reciprocates in the cylinder 10. The piston 12 is coupled by the connecting rod 13 to the crankshaft 14. The crankcase is provided with air induction ports 15, incorporating conventional reed valves 19 and three transfer passages 16 (only one shown) communicate the crankcase with respective transfer ports, two of which are shown at 17 and 18, the third being the equivalent to 17 on the opposite side of port 18.

The transfer ports are each formed in the wall of the cylinder 10 normally with their respective upper edge located in the same diametral plane of the cylinder. An exhaust port 20 is formed in the wall of the cylinder generally opposite the central transfer port 18. The upper edge of the exhaust port is slightly above the diametral plane of the transfer ports upper edges, and will accordingly close later in the engine cycle.

The detachable cylinder head 21 has a combustion cavity 22 into which the spark plug 23 and fuel injector nozzle 24 project. The cavity 22 is located substantially symmetrical with respect to the axial plane of the cylinder extending through the centre of the transfer port 18 and exhaust port 20. The cavity 22 extends across the cylinder from the cylinder wall immediately above the transfer port 18 to a distance past the cylinder centre line.

The cross sectional shape of the cavity 22 along the above referred to axial plane of the cylinder is substantially arcuate at the deepest point or base 28, with the centre line of the arc somewhat closer to the centre line of the cylinder than to the cylinder wall above the transfer port 18. The end of the arcuate base 28 closer to the cylinder wall above the transfer port 18, merges with a generally straight face 25 extending to the underface 29 of the cylinder head 21 at the cylinder wall. The face 25 is inclined upwardly from the cylinder wall to the arcuate base 28 of the cavity.

The opposite or inner end of the arcuate base 28 merges with a relatively short steep face 26 that extends to the underface 29 of the cylinder head. The face 26 also meets the underface 29 at a relatively steep angle. The opposite side walls of the cavity (one only being shown at 27) are generally flat and parallel to the above referred to axial plane of the cylinder, and so also meet the underface 29 of the cylinder head at a steep angle.

The injector nozzle 24 is located at the deepest part of the cavity 22, while the spark plug 23, is located in the face of the cavity remote from the transfer port 18. Accordingly, the air charge entering the cylinder will pass along the cavity past the injector nozzle 24 toward the spark plug and so carries the fuel from the nozzle to the spark plug.

Further details of the form of the cavity 22 and of the combustion process derived therefrom are disclosed in commonly assigned U.S. Pat. No. 4,719,880 entitled "Improvements Relating to Two Stroke Cycle Internal Combustion Engines", by Schlunke and Davis, the disclosure of which is hereby incorporated herein by reference.

Figure 2:
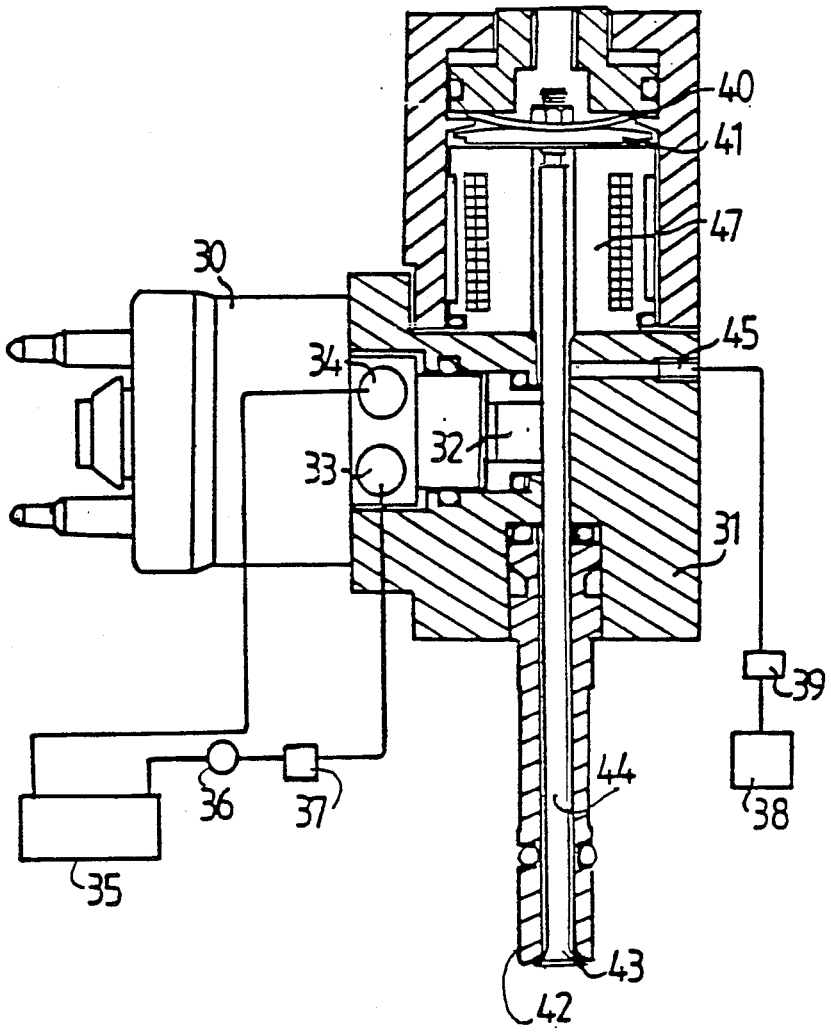
FIG. 2 is an elevational view partly in section of a fuel metering and injection device for which the present invention is applicable. It is shown diagrammatically coupled to its associated fuel and air supply.

The injector nozzle 24 is an integral part of a fuel metering and injection system whereby fuel entrained in air is delivered to the combustion chamber of the engine by the pressure of the air supply. One particular form of fuel metering and injection unit is illustrated in FIG. 2 of the drawings.

The fuel metering and injection unit incorporates a suitably available metering device 30, such as an automotive type throttle body injector, coupled to an injector body 31 having a holding chamber 32 therein. Fuel is drawn from the fuel reservoir 35 delivered by the fuel pump 36 via the pressure regulator 37 through fuel inlet port 33 to the metering device 30. The metering device operating in a known manner meters an amount of fuel into the holding chamber 32 in accordance with the engine fuel demand. Excess fuel supplied to the metering device is returned to the fuel reservoir 35 via the fuel return port 34. The particular construction of the fuel metering device 30 is not critical to the present invention and any suitable device may be used.

In operation, the holding chamber 32 is pressurised by air supplied from the air source 38 via pressure regulator 39 through air inlet port 45 in the body 31. Injection valve 43 is actuated to permit the pressurized air to discharge the metered amount of fuel through injector tip 42 into a combustion chamber of the engine. Injection valve 43 is of the poppet valve construction opening inwardly to the combustion chamber, that is, outwardly from the holding chamber.

The injection valve 43 is coupled, via a valve stem 44, which passes through the holding chamber 32, to the armature 41 of solenoid 47 located within the injector body 31. The valve 43 is biased to the closed position by the disc spring 40, and is opened by energising the solenoid 47. Energising of the solenoid 47 is controlled in timed relation to the engine cycle to effect delivery of the fuel from the holding chamber 32 to the engine combustion chamber.

Further details of the operation of the fuel injection system incorporating a holding chamber is disclosed in commonly assigned U.S. patent application Nos. 740067 filed 2nd April 1985, now U.S. Pat. Nos. 4,693,224 and 849501, filed March 24, 1986, by M. McKay, the disclosures of which are incorporated herein by reference.

Preferred forms of the head portion of the injection valve 43 are shown in FIGS. 3 to 6 which depict two views of two alternative forms of valve head intended to be used with a basically conventional valve seat. As seen in each of FIGS. 3 and 5, there are twelve equally spaced notches or slots 65 about the periphery of the head 48 of the valve, and an annular sealing face 61, which in use co-operates with a corresponding sealing face on a co-operating valve seat as indicated at 68 in FIG. 7. The included angle of the sealing face in these preferred forms is 120° but may be at any other appropriate angle such as, for example, the sometimes used 90° angle. In the embodiments shown the annular portion 62 of the valve head, in which the notches are provided, has the same included angle of taper as the sealing face 61, however this is not essential. For example, if the included angle of the sealing face is 90° the angle of the annular portion 62 may be 120°.

In each of the embodiments shown the twelve notches 65 are equally spaced around the perimeter of the head, and the opposite walls 66 are radial and have an included angle therebetween of 15°. In the specific valves shown in the drawings the overall diameter of the valve head is 4.7 millimetres while the width of the notch at the periphery is 0.7 millimetres and a total notch depth on the centre line of the notch and in the direction radial to the head is 0.7 millimetres.

The width of notches may vary to suit particular performance requirements and preferably the notches occupy 35 65% of the length of the edge in which they are located. Usually the notches occupy 40 to 60% of said edge length.

Figure 3:
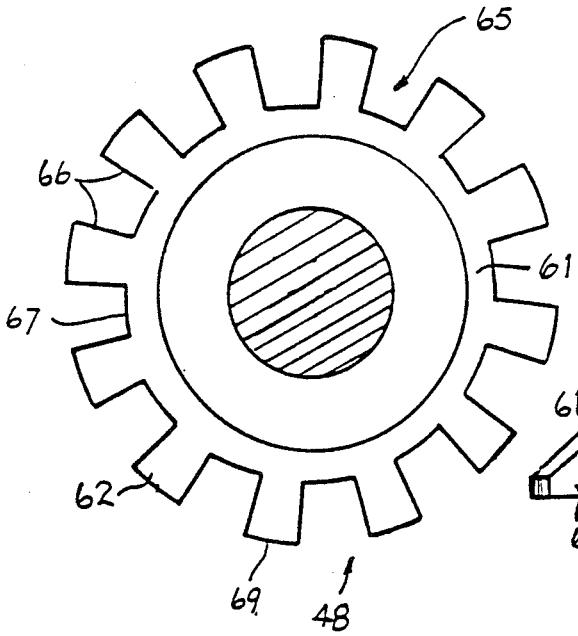
FIGS. 3 and 4 are end and side elevational views of one form of valve head embodying the present invention.
Figure 4:
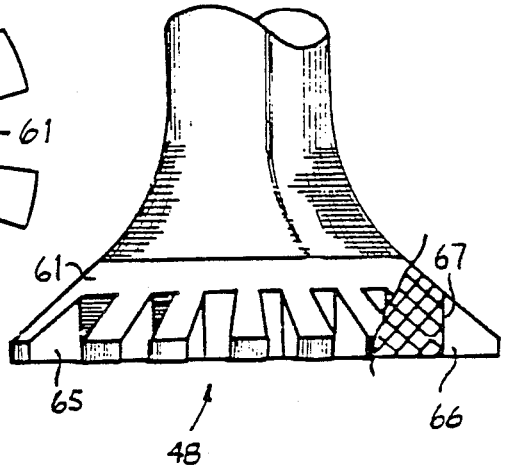

In the embodiment shown in FIGS. 3 and 4 the base 67 of each notch is parallel to the axis of the valve.

Figure 6:
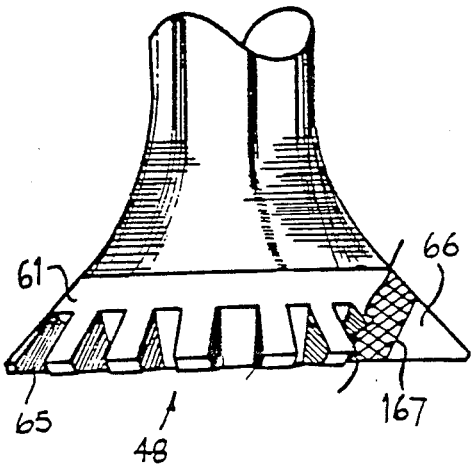

In alternative constructions the base of the notch may be of a configuration other than parallel to the axis of the valve, and typically may be inclined downwardly and inwardly towards the axis of the valve as at 167 in FIG. 6. In this emodiment the angle of the inclined base to the axis of the valve is 30°. In other variations (not shown) the base of the notch is curved in the direction from the top to the bottom of the valve head rather than flat.

Further, in the embodiments shown the opposite side walls 66 of the notches are in radial planes parallel to the axis of the valve, however, the notches may be arranged so that the side walls thereof are in planes inclined to the valve axis, and typically the inclination may be of order of 30°.

Figure 5:
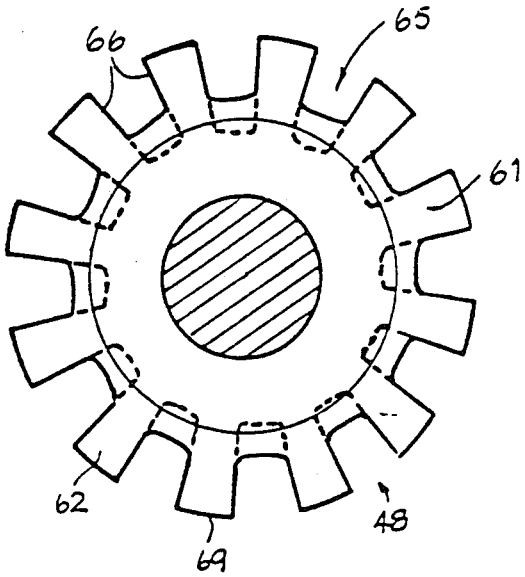
FIGS. 5 and 6 are end and side elevational views of another form of valve head embodying the present invention.

It is understood that the base 67, 167 of the notch in the above referred to embodiments need not be straight in the plane of the notch as shown in FIGS. 4 and 6 but may be of an arcuate form blending smoothly with the opposite side_walls 66 of the notch. Also the shape of the land 69 between respective notches may be of generally semi-circular cross section rather than of an arcuate form as shown in FIGS. 4 and 5 corresponding to the peripheral contour of the valve.

Figure 7:
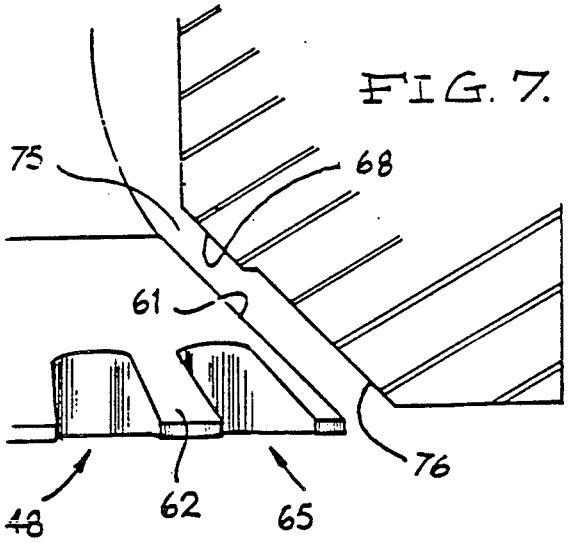
FIG. 7 is a sectional view to a large scale of part of the valve similar to that shown in FIGS. 5 and 6 and a complementary port and valve seat.

FIG. 7 of the drawings shows in part a poppet type valve, as above described, and the co-operating part of a port. The sealing face 68 of the port co-operates with the sealing face 61 of the valve head 48 when the valve is in the closed position. An annular passage 75 is formed between these sealing faces when the valve is open (as shown) through which the fuel-air mixture flows to be delivered into the combustion chamber.

The recessed face 76 of the port, downstream from the sealing face 68, has a clearance with respect to the notched portion 62 of the valve head 48. This clearance reduces the risk of the defective sealing of the valve as a result of carbon particles or other foreign matter on the face 76. Also as the valve does not contact the face 76 when closed, carbon particles initially deposited thereon are likely to be swept off by the fuel-air charge passing when the valve is open.

Figure 9:
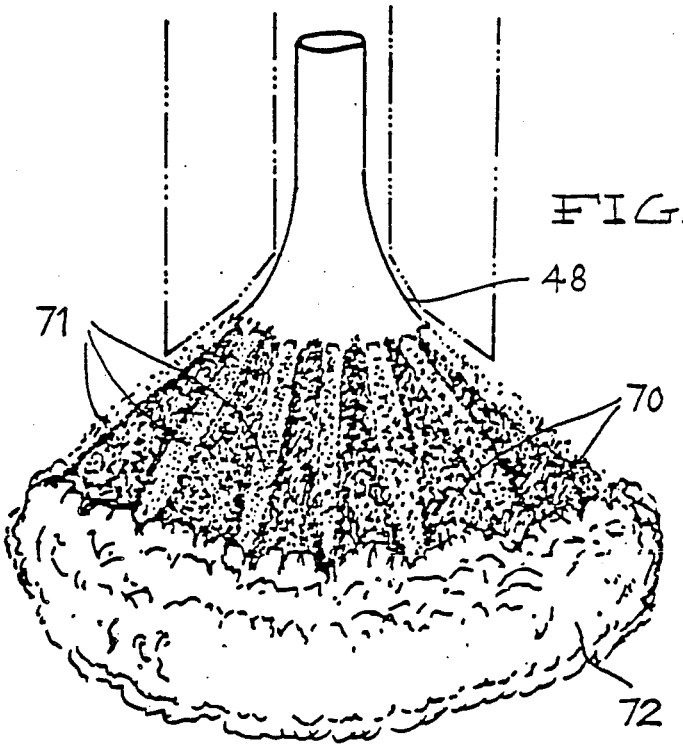
FIG. 9 illustrates the fuel cloud formation achieved with the valve head shape shown in FIGS. 5 to 6.

The notches in the periphery of the valve head divide the air entrained fuel flow into respective paths, that which pass over the normal peripheral edge of the valve, and that which passes through the notches. These respective flow paths in effect form the concentric arrays of air entrained fuel droplets and are depicted in FIG. 9 at 71 and 70. The streams issuing from the un-notched portion of the valve edged may be somewhat richer in fuel than the streams 71, as previously discussed. It will also be appreciated that the provision of the notches increases the flow path area for the gas and fuel and so reduces their velocity and thus the extent of penetration into the combustion chamber. Also the effective functioning of this valve is less dependent on smooth surfaces and uninterrupted flow, and so carbon built up on the valve and port surfaces are not a major problem.

FIG. 9 depicts the external appearance of the two arrays of fuel streams 70 and 71 and the resulting fuel cloud 72, and show that as streams move some distance from the nozzle and hence decelerate, the streams break up into a fuel mist. This mist is carried inwardly from the boundary array to form within the general confine of the streams a generally continuous cloud of fine droplets of fuel dispersed within a body of air.

Figure 10:
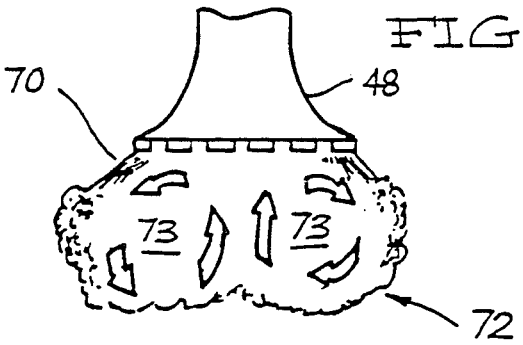
FIG. 10 is a sectional view through the fuel cloud shown in FIG. 9 illustrating flow patterns in the fuel cloud.

FIG. 10 is a sectional view which illustrates the basic flows associated with the formation of the fuel cloud 72. It will be noted that the streams 70 of air and fuel issue from the edge of the poppet valve on a divergent path, and so provide a pressure gradient below the valve head 48, which develops a generally toroidal air flow 73 within the volume bounded by the fuel-air streams 70. The path of the toroidal flow adjacent the streams 70 is in the same direction thereas, and the outer portion of the toroidal air flow will take up fuel droplets from the streams 70 and 71 and carry them inwardly to be dispersed within the air moving in the toroidal flow, which assists in breaking up and slowing down the air-fuel streams 70 and 71. Thus the effect of this toroidal air flow 73 is to generally prevent outward dispersion of the fuel droplets which would cause a relatively dispersed fuel cloud, and to carry the fuel drops towards the centre so that a concentrated fuel cloud 72 is established.

Figure 8:
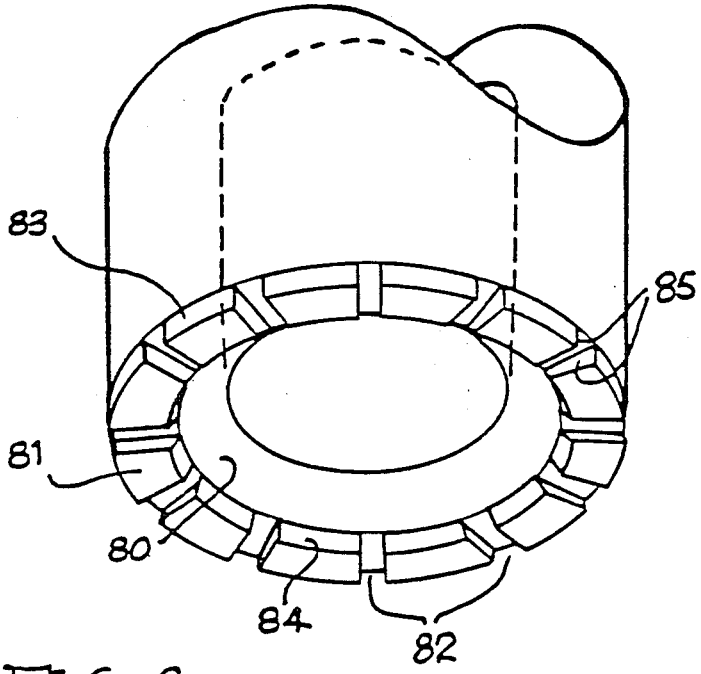
FIG. 8 is a perspective view of a valve port incorporating a further form of the present invention.

Although the preferred form of the invention has a series of notches in the perimetal area of the poppet valve head, beneficial results are also achieved with a series of notches in the port together with a conventional poppet valve without notches. A typical configuration of a notched port is shown in FIG. 8.

The port has an annular sealing face 80 which in use co-operates with a corresponding sealing face on a poppet valve. Downstream of the sealing face 80 is an annular end face 81 generally normal to the port axis, and an interconnecting generally cylindrical internal face 84. Twelve equally spaced notches 82 are formed in the end face 81 extending from the internal face 84 to the external peripheral face 83. Preferably the opposite walls 85 of the notches are parallel. The base of the notches is preferably flat, and parallel to the end face 81. The depth of the notch is such that part of the fuel-air charge travelling through the port towards the notch when the valve is open, will not impinge on the cylindrical surface 84 and will pass through the notched unimpeded. The art of the fuel-air charge that does impinge on the cylindrical surface 84 between the notches 82 is deflected to travel along that face.

The above described arrangement of notches in the port will divide the fuel-air mixture issuing from the port into two arrays of fuel droplets, an outer array issuing through the notches 82 and an inner array issuing from the un-notched portions of the internal face 81. In this arrangement the outer array is divergent with respect to the axis of the port generally continuing in the direction of the sealing face 80 while the inner array is generally of a cylindrical form following the internal face 81.

The fuel cloud created by the notched port is more widely dispersed than that resulting from a notched valve head of the same angle. It is also less penetrating, so the resultant fuel cloud may be principally retained within a combustion cavity provided in the cylinder head such as the cavity 22 in FIG. 1. Also when using the above notched port configuration the two arrays of fuel droplets provide an increased exposure of the fuel to air to promote ignitability and combustibility.

Figure 11:
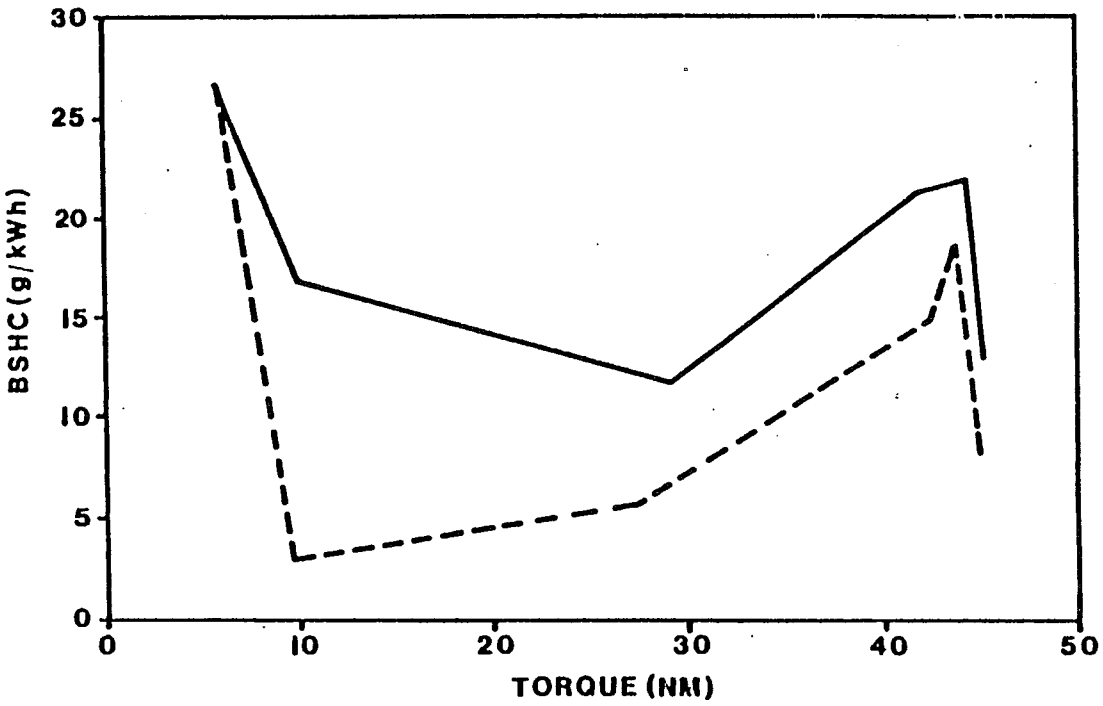
FIG. 11 is a graph showing a comparison of the HC content of the exhaust gas from engines operating with a plain poppet valve and the same engine with a notched poppet valve.

FIG. 11 contains plots of hydrocarbon content in the exhaust gas obtained from operating the same engine with a conventional poppet valve in the injector and with a notched poppet valve similar to that shown in FIGS. 3 and 4.

The solid line indicates the hydrocarbon content of the exhaust gas with the conventional poppet valve and the broken line hydrocarbons with the notched poppet valve. The engine used in this test was intended for automobile use where the majority of operation is in the low to medium power range, and this is the operating range where the notched poppet valve provided the higher rate of reduction of hydrocarbon in the exhaust gas. The notched poppet also contributes to a reduction in NOx in the exhaust, but to a lesser extent that the effect on hydrocarbons. The notched poppet is thus a development that contributes significantly to the control of emissions in the exhaust of internal combustion engines, particularly automobile type engines.

It is to be understood that the present invention may be applied to any form of fuel injection system wherein the fuel is entrained in air or another gas, particularly a combustion supporting gas, and is delivered into a combustion chamber through a nozzle.

In one particular fuel injection system a metered quantity of fuel is delivered into a body of air and so formed fuel and air mixture is discharged through a nozzle to the engine combustion chamber, upon opening of the nozzle by the pressure differential existing between the body of air and the combustion chamber. The body of air may be static or moving as the fuel is metered thereinto. The mode of metering the fuel may be of any suitable type including pressurised fuel supplies that issue for an adjustable time period into the air body, or individual measured quantities of fuel delivered, such as by a pulse of air, into the body of air.

Fuel injection systems and metering devices suitable for use in carrying the present invention into practice are disclosed in our U.S.A. Pat. Nos. 4,462,760, 4,554,945, 4,693,224, 4,719,880 and commonly assigned U.S. patent application No. 849,501, filed Mar. 24, 1986, the disclosures in each being herewith incorporated in this specification by reference.

In the present specification specific reference has been made to the use of the present invention in conjunction with an engine operating on the two-stroke cycle and with spark ignition, however it is to be understood that the invention is equally applicable to spark ignited engines operating on the four stroke cycle. The invention is applicable to internal combustion engines for all uses but is particularly useful in contributing to fuel economy and control of exhaust emissions in engines for or in vehicles, including automobiles, motor cycles and boats including outboard marine engines.

We claim:

1. A method of injecting fuel into a combustion chamber of a spark ignited internal combustion engine comprising entraining the fuel in a gas stream and selectively opening a port to inject the fuel-gas mixture so formed into the combustion chamber, and promoting preferred respective paths for the fuel-gas mixture as it passes through the port to produce a circular array of alternate first and second flow paths for the fuel-gas mixture issuing from the open port, with the fuel-gas mixture following said second paths issuing inwardly with respect to the fuel-gas mixture following said first paths.

2. A method as claimed in claim 1 wherein the first flow paths for the gas entrained fuel diverge outwardly with respect to the axis of the array.

3. A method as claimed in claim 1 wherein the first flow paths for the gas entrained fuel diverge outwardly with respect to the second flow paths.

4. A method as claimed in claim 1 wherein the second flow paths for the gas entrained fuel converge inwardly with respect to the axis of the array.

5. A method as claimed in claim 1, 2 or 3 wherein during formation of the first and second flow paths fuel is shed from the gas entering the second flow paths and taken up by the gas entering the first flow paths so that the fuel content of the fuel-gas mixture in the first flow paths is greater than the mixture in the second flow paths.

6. A method as claimed in claim 1 wherein the first flow paths for the gas entrained fuel diverge outwardly with respect to the axis of the array and the second flow paths for the gas entrained fuel converge inwardly with respect to the axis of the array.

7. A method as claimed in claim 6 wherein during formation of the first and second flow paths fuel is shed from the gas entering the second flow paths and taken up by the gas entering the first flow paths so that the fuel content of the fuel-gas mixture in the first flow paths is greater than the mixture in the second flow paths.

8. A method as claimed in claim 6 or 7 wherein the fuel-gas mixture is injected into the combustion chamber through a port and a valve element is selectively movable relative to the port to open and close the port, said port and valve element defining an annular passage when the port is open, said passage having a series of notches along at least one of the peripheral edges of said annular passage, said fuel-gas mixture being propelled through said passage with part of the mixture passing through said notches to follow a flow path and the remainder over said peripheral edge between the notches to follow a different flow path.

9. A method as claimed in claim 1, 2 or 3 wherein the fuel-gas mixture is injected into the combustion chamber through a port and a valve element is selectively movable relative to the port to open and close the port, said port and valve element defining an annular passage when the port is open, said passage having a series of notches along at least one of the peripheral edges of said annular passage, said fuel-gas mixture being propelled through said passage with part of the mixture passing through said notches to follow a flow path and the remainder passing over said peripheral edge between the notches to follow a different flow path.

10. In a fuel injection system for internal combustion engines where fuel entrained in gas in injected into a combustion chamber as a fuel-gas mixture, flow means for providing a circular array of alternate first and second flow paths for the fuel-gas mixture when the mixture is being injected into the combustion chamber with the fuel-gas mixture following said second flow paths issuing into the combustion chamber inwardly with respect to the fuel-gas mixture following said first flow paths.

11. A fuel injection system as claimed in claim 10 wherein said first flow paths diverge outwardly with respect to the axis of the array.

12. A fuel injection system as claimed in claim 10 or 11 wherein said second flow paths converge inwardly with respect to the axis of the array.

13. A fuel injection system as claimed in claim 10 or 11 including nozzle means incorporating an openable nozzle through which the fuel and gas mixture is delivered to the combustion chamber and flow divider means, in the path of the mixture issuing through the nozzle when open, for forming said circular array of alternate first and second flow paths.

14. A fuel injection system as claimed in claim 10 or 11 wherein said second flow paths converge inwardly with respect to the axis of the array, and said flow means includes nozzle means incorporating an openable nozzle through which the fuel and gas mixture is delivered to the combustion chamber and flow divider means, in the path of the mixture issuing through the nozzle when open, for forming said circular array of alternate first and second flow paths.

15. A fuel injection system as claimed in claim 13 wherein said nozzle means includes a port through which the fuel-gas mixture issues into the combustion chamber, a valve element operable to selectively open and close said port, said valve element and port having respective portions defining therebetween when the port is open a passage from which the fuel-gas mixture will issue into the combustion chamber, one of said portions incorporating said flow divider means.

16. A fuel injection system as claimed in claim 15 wherein said flow divider means comprises discontinuities in said one portion at that edge from which the mixture issues, for deflecting the fuel-gas mixture passing through the discontinuities from the trajectory of the remainder of the fuel-gas mixture such that the mixture is deflected inwardly with respect to the mixture passing the remainder of said edge to follow said second paths.

17. A fuel injection system claimed in claim 16 wherein said discontinuities comprise a plurality of spaced notches in said valve element.

18. A fuel injection system as claimed in claim 13 wherein said nozzle means comprises a port through which the fuel-gas mixture passes to the combustion chamber, a valve element operable to selectively open and close said port, the valve element and port having respective annular surfaces which define, when the port is open, an annular passage through which the fuel-gas mixture passes to the combustion chamber, one of said surfaces having a terminal edge portion at the downstream end thereof, and a plurality of notch means in said terminal edge portion for forming the second flow paths.

19. A fuel injection system as claimed in claim 17 wherein the port and valve element are each of a circular cross-section and have respective annular sealing faces which close the port when in mutual engagement, said valve element having a terminal edge portion and being displaceable relative to the port in the direction towards the combustion chamber to effect opening of the port, said notches being provided in the terminal edge portion of the valve element.

20. A fuel injection system as claimed in claim 19 wherein the notches are equally spaced around the periphery of the terminal edge portion of the valve element.

21. A fuel injection system as claimed in claim 18 wherein each notch has opposite side walls extending inwardly from the periphery of the terminal edge portion, said side walls being in respective planes parallel to the valve element axis.

22. A fuel injection system as claimed in claim 18 wherein each notch has opposite side walls in planes radial to the valve element axis.

23. A fuel injection system as claimed in claim 18 wherein each notch has opposite side walls in respective planes inclined to the valve element axis.

24. A fuel injection system as claimed in claim 20 wherein each notch has a base wall extending between the side wall, said base wall being in a plane inclined inwardly toward the valve element axis.

25. A fuel injection system as claimed in claim 24 wherein said plane of the base wall is inclined at 30° to the valve element axis.

26. A fuel injection system as claimed in claim 18 wherein the port and valve element are each of a circular cross-section and have respective annular sealing faces which close the port when in mutual engagement, said valve element having a terminal edge portion and being displaceable relative to the port in the direction towards the combustion chamber to effect opening of the port, said notches being provided in the terminal edge portion of the valve element.

27. A fuel injection system as claimed in claim 26 wherein said terminal edge portion presents an internal cylindrical or conical wall and the notches extending outwardly through said wall with respect to the axis thereof.

28. A fuel injection system as claimed in claim 26 wherein the notches are spaced equally about the periphery of the wall.

29. A fuel injection system as claimed in claim 28 wherein the notches occupy between 35% and 65% of the length of said edge.

30. A fuel injection system as claimed in claim 29 wherein the notches occupy between 40% and 60% of the length of said edge.

31. A fuel injection system as claimed in claim 14 wherein said nozzle means includes a port through which the fuel-gas mixture issues into the combustion chamber, a valve element operable to selectively open and close said port, said valve element and port having respective portions defining therebetween when the port is open a passage from which the fuel-gas mixture will issue into the combustion chamber, one of said portions incorporating said flow divider means.

32. A fuel injection system as claimed in claim 31 wherein said flow divider means comprises discontinuities in said one portion at that edge from which the mixture issues, for deflecting the fuel-gas mixture passing through the discontinuities from the trajectory of the remainder of the fuel-gas mixture such that the mixture is deflected inwardly with respect to the mixture passing the remainder of said edge to follow said second paths.

33. A fuel injection system claimed in claim 32 wherein said discontinuities comprise a plurality of spaced notches in said valve element.

34. A fuel injection system as claimed in claim 14 wherein said nozzle means comprises a port through which the fuel-gas mixture passes to the combustion chamber, a valve element operable to selectively open and close said port, the valve element and port having respective annular surfaces which define, when the port is open, an annular passage through which the fuel-gas mixture passes to the combustion chamber, one of said surfaces having a terminal edge portion at the downstream end thereof, and a plurality of notch means in said terminal edge portion for forming the second flow paths.

35. A fuel injection system as claimed in claim 33 wherein the port and valve element are each of a circular cross-section and have respective annular sealing faces which close the port when in mutual engagement, said valve element having a terminal edge portion and being displaceable relative to the port in the direction towards the combustion chamber to effect opening of the port, said notches being provided in the terminal edge portion of the valve element.

36. A fuel injection system as claimed in claim 35 wherein the notches are equally spaced around the periphery of the terminal edge portion of the valve element.

37. A fuel injection system as claimed in claim 34 wherein each notch has opposite side walls extending inwardly from the periphery of the terminal edge portion, said side walls being in respective planes parallel to the valve element axis.

38. The fuel injection system of claim 10, further including a valve element, said valve element comprising a valve head having a generally conical peripheral surface with a terminal edge at the larger end thereof, said peripheral surface including annular sealing surface means for cooperating in use with a port to form a seal therewith, and a plurality of notches in said peripheral surface between said annular sealing surface and said terminal edge, said notches being spaced peripherally about the valve head and extending through said terminal edge.

39. The fuel injection system of claim 10, further including a port seat unit, said port seat unit comprising annular sealing surface means for cooperating in use with a valve element to form a seal therewith, and an annular wall portion extending from said sealing surface means to a terminal edge, said annular wall portion having a plurality of peripherally spaced notches extending through the annular wall portion from the terminal edge toward the sealing surface means.

* * * * *